US007187875B2

(12) United States Patent
Kwon

(10) Patent No.: US 7,187,875 B2
(45) Date of Patent: Mar. 6, 2007

(54) IMAGE FORMING DEVICE DETERMINING COMPONENTS REPLACEMENT TIME ACCORDING TO ENVIRONMENT AND METHOD THEREOF

(75) Inventor: Tai-eun Kwon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 209 days.

(21) Appl. No.: 10/964,711

(22) Filed: Oct. 15, 2004

(65) Prior Publication Data

US 2005/0141903 A1 Jun. 30, 2005

(30) Foreign Application Priority Data

Dec. 24, 2003 (KR) ..... 10-2003-0096780

(51) Int. Cl.
*G03G 15/00* (2006.01)

(52) U.S. Cl. ..... 399/24; 399/43; 399/44

(58) Field of Classification Search ..... 399/24, 399/25, 26, 27, 43, 44; 347/19; 358/406, 358/504

See application file for complete search history.

(56) References Cited

U.S. PATENT DOCUMENTS

| | | | | |
|---|---|---|---|---|
| 5,119,141 | A * | 6/1992 | Bhagat | 399/44 |
| 5,655,174 | A * | 8/1997 | Hirst | 399/27 |
| 5,834,116 | A | 11/1998 | Sawa | |
| 6,510,294 | B1 * | 1/2003 | Hakamada | 399/27 |
| 6,625,403 | B2 * | 9/2003 | Carling et al. | 399/24 |
| 2004/0126123 | A1 * | 7/2004 | Koga et al. | 399/24 |
| 2004/0136735 | A1 * | 7/2004 | Jeong | 399/24 |
| 2004/0228642 | A1 * | 11/2004 | Iida et al. | 399/27 |

FOREIGN PATENT DOCUMENTS

| | | |
|---|---|---|
| JP | 10-333509 | 12/1998 |
| JP | 2000-98771 | 4/2000 |
| JP | 2000-098771 | 4/2000 |
| KR | 010009057 | 2/2001 |
| KR | 2003-0043754 A | 6/2003 |
| KR | 2003-43754 A | 6/2003 |

OTHER PUBLICATIONS

Korean Official Action issued on Jul. 22, 2005, for Korean Patent Application No. 2003-96780 (listing 3 references).

* cited by examiner

*Primary Examiner*—Sophia S. Chen
(74) *Attorney, Agent, or Firm*—Stanzione & Kim, LLP

(57) ABSTRACT

An image forming device determines the replacement time of components depending on environment. The image forming device includes an engine part performing the printing job using a certain component upon receiving the print command, a printout counter counting the actual number of the printed sheets, an environment detector detecting a certain environmental information by checking status of each component, a memory containing the maximum number of the printable sheets of the component, and a controller driving the component by reading out the operating condition from the memory corresponding to the received environmental information and determining the replacement time of the component by determining the total number of the printed sheets by differentially compensating and accumulating the counted number of the printed sheets depending on the environmental information, and comparing with the maximum number of the printable sheets. Accordingly, accurate replacement time of the component can be estimated.

29 Claims, 4 Drawing Sheets

IMAGE FORMING DEVICE DETERMINING COMPONENTS REPLACEMENT TIME ACCORDING TO ENVIRONMENT AND METHOD THEREOF

CROSS-REFERENCE TO RELATED APPLICATIONS

This application claims the benefit of Korean Patent Application No. 2003-96780, filed on Dec. 24, 2003 in the Korean Intellectual Property Office, the disclosure of which is incorporated herein by reference and in its entirety.

BACKGROUND OF THE INVENTION

1. Field of the Invention

The present general inventive concept generally concerns an image forming device. More specifically, the present general inventive concept is directed to an image forming device capable of calculating a life span of a consumable component by reflecting an environment of the image forming device and a method thereof.

2. Description of the Related Art

The prevalence of a computer has given rise to that of peripherals such as an image forming device including, for example, a printer, a copier, a fax machine, and a multi-functional machine. The image forming device commonly adopts a structure and a working principle of the printer which prints certain data onto a printing paper.

The structure of the printer is divided into a control part and an engine part. The control part interprets image data from a computer, stores the interpreted data into a memory of the printer, and transfers the stored data in a form of serial data after communicating with the engine part so that the engine part performs a printing operation.

The engine part is a mechanical component which prints onto the printing paper the print data transferred from the control part. The engine part of a laser printer may include an organic photoconductive drum (hereinafter, refer to as a photoconductive drum), a writing part, a developing part, a charging part, a transferring part, and a fusing part.

FIG. 1 illustrates a construction of the engine part of the laser printer. Referring to FIG. 1, when a printing paper 11 is fed from a feeding part 10, the charging part 50 charges a surface of the photoconductive drum 30 with a negative charge using a charging wire or a rubber roller. The rubber roller is generally used for the charging. The surface of the photoconductive drum 30 is charged with −600V to −1000V DC by closely contacting the rubber roller with the surface and applying a voltage of a predetermined range.

The writing part 40 exposes a laser beam onto the surface of the photoconductive drum 30 using a laser scanning unit (LSU), and produces a latent image by neutralizing the scanned area. The developing part 20 develops the latent image to a visible image by attracting a toner onto the surface of the photoconductive drum 30 using a developing roller.

The toner on the surface of the photoconductive drum 30 is transferred onto the printing paper 11. The transferring part 60 closely contacts a transferring roller to a back side of the printing paper 11, applies an electrostatic force through a corona discharge by applying a high positive voltage so that the toner is transferred onto the printing paper since the electrostatic force is greater than adhesion of the toner to the photoconductive drum 30.

The fusing unit 70 fixes the toner on the printing paper 11 using a press roller 71 and a heating roller 72, and the printed paper is discharged.

Still referring to FIG. 1, the engine part may include a certain part, such as the transferring roller of the transferring part 60 and a charging roller of the charging part 50, of which an operating condition may change depending on an overall environment. The overall environment of the certain part is checked and its operating condition is correspondingly set prior to the operation.

FIG. 2 illustrates the transferring roller 61 which closely contacts the photoconductive drum 30 with the printing paper put between the photoconductive drum 30 and the transferring roller 61. The transferring roller 61, which is a critical part of the transferring part 60, is a kind of a rubber roller including an iron core 61*b* and a rubber 61*a*. When the voltage is applied through the iron core 61*b*, the positive charge is discharged onto the surface of the rubber 61*a*, thus transferring the toner.

The rubber 61*a* of the transferring roller 61 is apt to be affected by the environment, such as temperature or humidity, so that its resistance may vary. However, since the voltage for the transferring is uniform, the resistance of the transferring roller 61 is measured and the voltage applied to the iron core 61*b* is adjusted according to the measurement, to thus maintain suitable transferring current irrelevant of the resistance. Namely, the transferring roller 61 needs the adjustment of the operating condition, that is, the applied voltage depending on the environment. The charging roller of the charging part 50 may be a rubber roller, and also requires a uniform voltage. The uniform voltage of the charging roller is applied as in the transferring roller 61.

Each part of the laser printer has a limited life span and replacement time. For example, the more usage of the rubber 61*a* of the transferring roller 61 results in a greater resistance. The transferring may not be normally performed after printing more than a predetermined number of sheets since the suitable transferring voltage cannot be maintained.

Accordingly, the image forming device counts and accumulates a number of revolutions of a pickup roller (not shown), which is a part of the feeding part 10 for picking up and feeding the printing paper 11, so as to determine the replacement time of each part. When the accumulated number of the printed papers is compared with and exceeds a preset number of the printed papers of each part, the image forming device determines the replacement.

However, the conventional image forming device determines the replacement time of each part without consideration of its environment, which may not correspond to the actual replacement time. Solidity of the rubber of the rubber roller may vary significantly depending the temperature and the humidity, and accordingly, its resistance may vary. Specifically, a high transferring voltage is required in low temperature and low humidity since the resistance increases due to static electricity on the surface of the printing paper and increased solidity of the rubber. The more the printed papers are yielded, the more the solidity of the rubber increases. As a result, the resistance continuously increases so that the life span of the rubber roller is shortened as compared with normal temperature and humidity. Conversely, the life span of the rubber roller is lengthened in high temperature and high humidity since a relatively low transferring voltage is applied.

Since the conventional image forming device does not consider the environment of each part, the still available component may be replaced in the high temperature and humidity, and the exhausted component is not replaced in the low temperature and humidity so as to depreciate the quality of the printed image. These problems may arise not only to the transferring roller but also to the other parts of which the replacement times are different from each other depending on the environment even when the replacement time is determined based on the number of the printed sheets.

SUMMARY OF THE INVENTION

Accordingly, it is an aspect of the present general inventive concept is to provide an image forming device capable of determining an actual replacement time of a component by differentially counting a number of printed sheets depending on overall environment, and a method thereof.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing an image forming device including an engine part performing a printing job using a certain component upon receiving a print command, an environment detector detecting environmental information of the engine part, and a controller determining a replacement time of the certain component according to a detection result of the environment detector.

The image forming device may further include a display displaying the replacement time of the certain component when the controller determines the replacement time.

The image forming device may further include a printout counter counting the actual number of the printed sheets of the engine part, and a memory containing the maximum number of the printable sheets of the certain component.

According to an aspect of the present general inventive concept, the controller determines a total number of the printed sheets by compensating the actual number of the printed sheets based on the environmental information, and determines the replacement time of the certain component when the actual number of the printed sheets exceeds a predetermined maximum number of printable sheets of the certain component.

The controller may determine the total number of the printed sheets by dividing an environment of the engine part into a plurality of sections depending on the environmental information, and compensating the actual number of the printed sheets using a compensation coefficient, which is set differentially for each section.

The compensation coefficient may be set by experimentally measuring the maximum number of the printable sheets in each section, calculating a ratio between the maximum numbers of the printable sheets based on the maximum number of the printable sheets in a certain section, and setting the compensation coefficient in inverse proportion to the calculated ratio.

The environment detector detects the environmental information with respect to at least one of a temperature and a humidity. The controller can divide the environment of the engine part into a low temperature and low humidity (L/L), a normal temperature and normal humidity (N/N), and a high temperature and high humidity (H/H) depending on the environmental information. The controller determines, in view of the environment of the engine part being the N/N, that the replacement time relatively advances in the L/L and that the replacement time becomes relatively delayed in the H/H.

If the image forming device adopts a laser beam, the engine part includes a photoconductive medium (photoconductive drum or photoconductive belt). The replacement time can be determined with respect to components including the photoconductive medium, a developing roller attracting the toner onto the surface of the photoconductive medium, a charging roller charging the surface of the photoconductive medium with the negative charge, and a transfer roller transferring the toner on the surface of the photoconductive medium onto the printing paper.

The method of determining the replacement time of the certain component of the image forming device includes performing the print job by driving the certain component upon receiving a print command, detecting environmental information with respect to an environment of the image forming device, and determining the replacement time of the certain component depending on the detected environmental information.

The method may further include displaying a replacement message of the certain component when the replacement time of the certain component is determined.

The operation of determining the replacement time of the certain component depending on the detected environmental information may include counting a number of printed sheets of the image forming device, determining a total number of the printed sheets by differentially compensating the number of the printed sheets depending on the environmental information, and determining the replacement time of the certain component when the total number of the printed sheets exceeds a maximum number of printable sheets of the certain component.

The operation of determining a total number of the printed sheets by differentially compensating the number of the printed sheets depending on the environmental information may include dividing the environment of the image forming device into a plurality of sections depending on the environmental information, and determining the total number of the printed sheets by compensating an actual number of the printed sheets using a compensation coefficient differentially set for each section. The compensation coefficient may be set by experimentally measuring the maximum number of the printable sheets in each section, calculating a ratio between the maximum numbers of the printable sheets based on the maximum number of the printable sheets in a certain section, and setting the compensation coefficient in inverse proportion to the calculated ratio.

The environmental information is related to at least one of a temperature and a humidity. The operation of determining a total number of the printed sheets by differentially compensating the number of the printed sheets depending on the environmental information divides the environment of the image forming device into a low temperature and low humidity (L/L), a normal temperature and normal humidity (N/N), and a high temperature and high humidity (H/H).

The operation of determining the replacement time of the certain component when the total number of the printed sheets exceeds a maximum number of printable sheets of the certain component determines, with the environment of the image forming device being the N/N, that the replacement time relatively advances in the L/L and that the replacement time is relatively delayed in the H/H.

Accordingly, an image forming device, especially a laser image forming device, can determine the substantial replacement time with respect to a component, such as a photoconductive medium, a developing roller, a charging roller, and a transfer roller, which has a variable operating condition and a variable life span depending on an environment in which it is placed.

BRIEF DESCRIPTION OF THE DRAWINGS

These and/or other aspects and advantages of the general inventive concept will become apparent and more readily appreciated from the following description of the embodiments, taken in conjunction with the accompanying drawing figures of which.

DETAILED DESCRIPTION OF THE PREFERRED EMBODIMENTS

Figure 1:
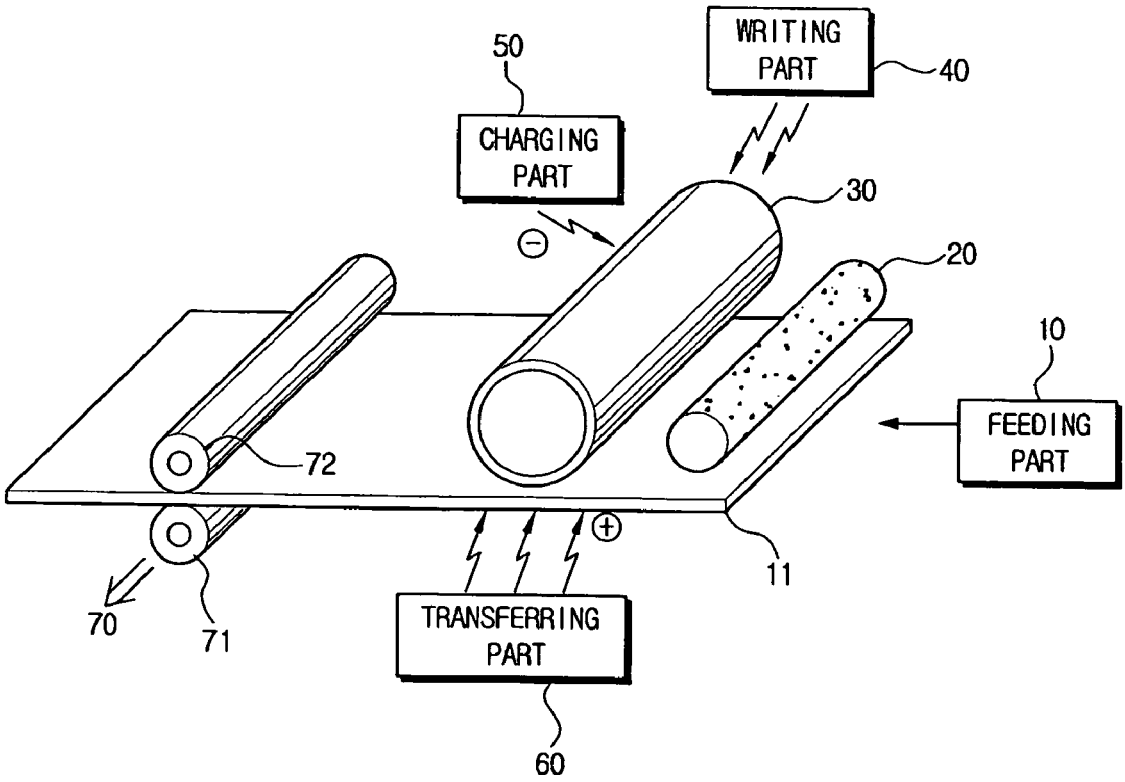
FIG. 1 (PRIOR ART)
FIG. 1 is a schematic diagram illustrating a construction of an engine part of a conventional image forming device.
Figure 2:
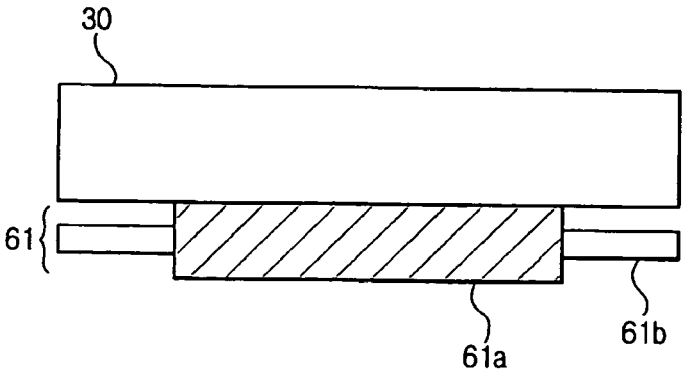
FIG. 2 (PRIOR ART)
FIG. 2 is a schematic diagram illustrating a transferring roller and a photoconductive drum of the conventional image forming device of FIG. 1.

Reference will now be made in detail to the embodiments of the present general inventive concept, examples of which are illustrated in the accompanying drawing figures, wherein like reference numerals refer to the like elements throughout. The embodiments are described below in order to explain the present general inventive concept by referring to the drawing figures.

Figure 3:
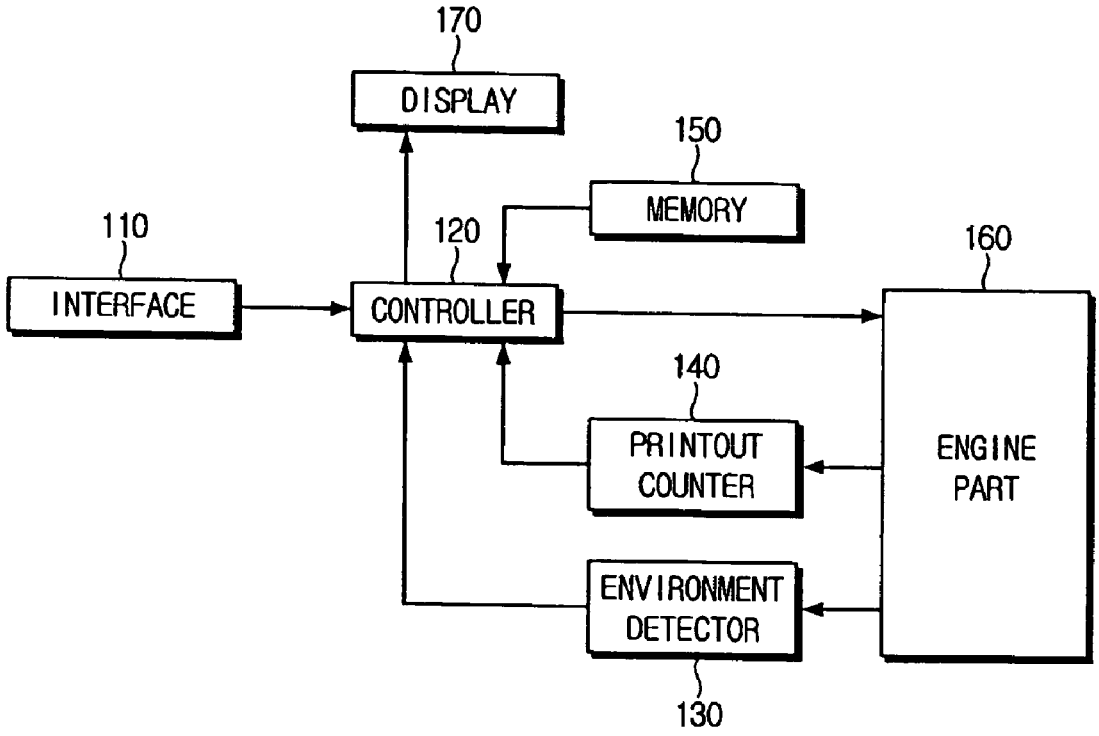
FIG. 3 is a block diagram illustrating an image forming device according to an embodiment of the present general inventive concept.

FIG. 3 is a block diagram of an image forming device according to an embodiment of the present general inventive concept. The image forming device includes an interface 110, a controller 120, an environment detector 130, a printout counter 140, a memory 150, an engine part 160, and a display 170.

The interface 110 receives print data and a print command from an external source. When the print command is received by the interface 110, the controller 120 drives the engine part 160 to perform a print job.

The engine part 160 prints onto a printing paper the print data processed by the controller 120. The engine part 160 performs the print job using a plurality of mechanical components. For example, a laser printing operation includes a photoconductive drum, a writing part, a developing part, a charging part, a transferring part, and a fusing part.

The environment detector 130 detects environmental information with respect to all circumstances around the image forming device, and especially around the engine part 160. The environment information may relate to a temperature and a humidity. The environmental information is necessary to properly adjust an operating condition of a certain component, since the certain component of the engine part 160 may need the adjustment of the operating condition depending on the environment.

For example, a transfer roller of the laser printer is provided with an operating current so as to adjust to a predetermined transfer current for the transfer operation. A resistance of the transfer roller may vary depending on the environment. Specifically, the resistance of the transfer roller decreases in high temperature and high humidity, and the resistance of the transfer roller increases in low temperature and low humidity. Accordingly, the predetermined transfer current is maintained by adjusting and applying the transfer voltage, that is, the operating condition corresponding to the variance of the resistance.

The environment detector 130 may adopt various methods to detect the environmental information. In general, the environmental information may be detected by applying a measuring voltage to the transfer roller, detecting the current, and measuring the resistance of the transfer roller.

Upon receiving the print command through the interface 110, the controller 120 warms up the engine part 160 by sending a control signal to the engine part 160. When the environment detector 130 detects certain environmental information, the controller 120 drives each component according to the respective operating condition, which is dependent on the detected environmental information.

The memory 150 contains the operating condition for the environmental information with respect to the components of which the operating condition varies depending on the environmental information.

According to an embodiment of the present general inventive concept, a life span of the component of the image forming device is determined based on a number of printed sheets. The substantial life span of the component is measured by compensating the number of the printed sheets based on the environmental information measured with respect to all circumstances in the environment detector 130.

The memory 150 contains a maximum number of printable sheets as well as the operating condition of each component. The maximum number of the printable sheets represents the maximum number of pages that each component affords to print. When the number of the printed sheets exceeds the maximum number of the printable sheets, the related component has to be replaced. The maximum number of the printable sheets is experimentally measured by a manufacturer of the image forming device, and is contained in the memory 150.

According to an embodiment of the present general inventive concept, the printout counter 140 counts the actual number of the printed sheets to determine the excess of the maximum number of the printable sheets. The printout counter 140 determines the number of the printed sheets by counting a number of revolutions of a pickup roller which feeds printing sheets. The controller 120 measures a total number of the sheets actually printed by consecutively accumulating the number of the printed sheets counted in the printout counter 140.

The controller 120 determines the total number of the printed sheets by compensating the number of the sheets actually printed, based on the environmental information with respect to all circumstances. Specifically, the total number of the printed sheets is determined in a manner in which the environmental information is divided into a plurality of sections, and the number of the printed sheets within each section is compensated using a compensation coefficient which is set differentially in each section, based on the following Equation 1.

$$L=\alpha A+\beta B+\ldots+\delta N \qquad \text{[Equation 1]}$$

In Equation 1, A,B, . . . , N respectively denote the number of the printed sheets within 1,2, . . . , N sections, α,β, . . . , δ respectively denote the compensation coefficient for 1, 2, . . . , N sections, and L denotes the total number of the printed sheets.

Each compensation coefficient may be determined by comparing the maximum number of the printable sheets in each section.

Upon determining the total number of the printed sheets, the controller 120 compares this number with the maximum number of the printable sheets pre-stored in the memory 150, and determines the replacement when the total number of the printed sheets is greater than the maximum number of the printable sheets. Upon determining the replacement, the controller 120 controls the display 170 to show a certain message notifying a user of the replacement of the related component.

The transfer roller is exemplified to explain that the controller 120 determines the total number of the printed sheets depending on the environment in which a component, such as the transfer roller, is placed.

Figure 4:
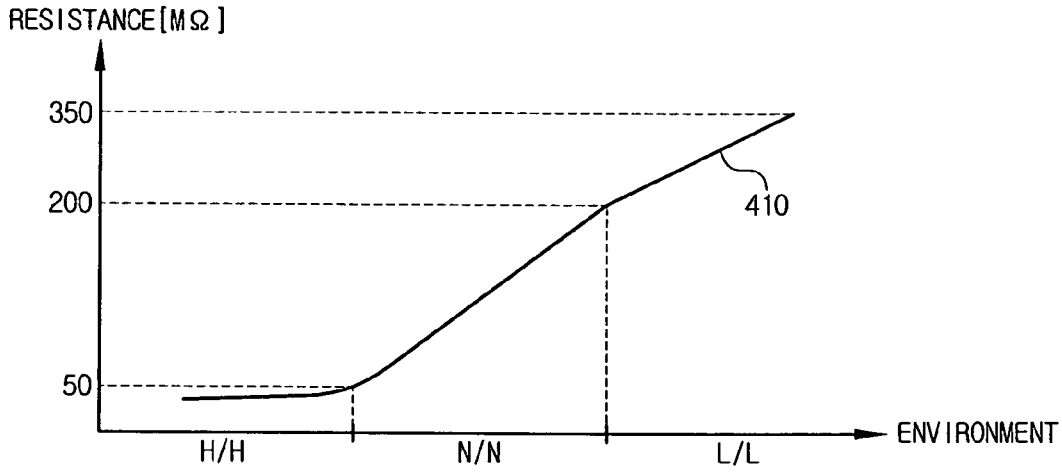
FIG. 4 is a graph illustrating experimental measurements of a resistance of a transfer roller varying depending on an environment in which it is placed, according to an embodiment of the present general inventive concept.

FIG. 4 is a graph illustrating a variance of the resistance of the transfer roller of the engine part 160 depending on the environment in which it is placed, according to an embodiment of the present general inventive concept. Referring to FIG. 4, a curve 410 indicates resistances in a high temperature and high humidity (H/H) environment, in a normal temperature and normal humidity (N/N) environment, and in a low temperature and low humidity (L/L) environment. In particular, the resistance is approximately less than 50 MΩ in high temperature and high humidity (H/H) environment, approximately between 50 MΩ and 200 MΩ in normal temperature and normal humidity (N/N) environment, and approximately greater than 200 MΩ in low temperature and low humidity (L/L) environment. That is, the lower the temperature and the humidity, the greater the resistance. This variation results from the increased solidity of a rubber of the transfer roller due to the low temperature and static electricity due to the low humidity. The memory 150 contains the voltage value corresponding to the resistance. When the environment detector 130 detects a specific environmental information, the controller 120 applies the voltage value corresponding to the specific environmental information to the transfer roller to perform the transfer operation.

Figure 5:
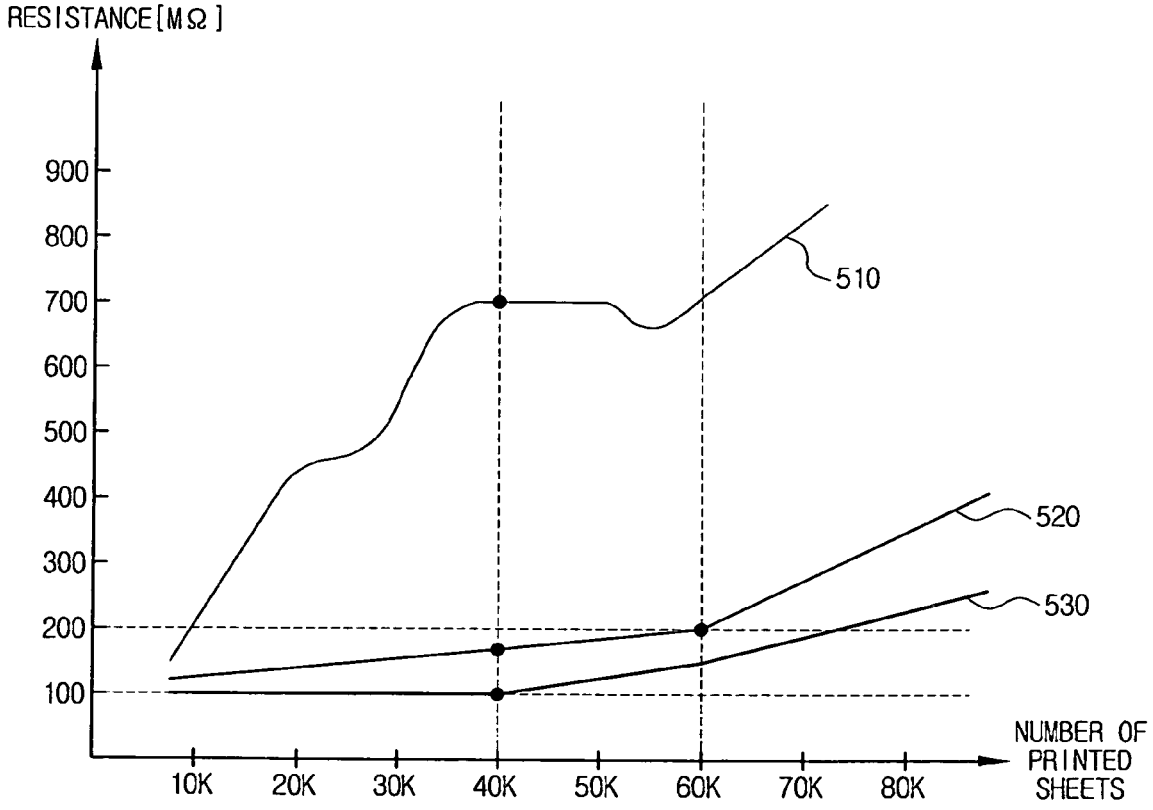
FIG. 5 is a graph illustrating experimental measurements of the resistance of the transferring roller varying depending on a number of printed sheets and the environment in which it is placed, according to an embodiment of the present general inventive concept.

FIG. 5 is a graph of the variance of the resistance of the transfer roller according to the number of the printed sheets and the environment in which the transfer roller is placed. Referring to FIG. 5, a first curve 510 indicates the resistance in the L/L environment, a second curve 520 indicates the resistance in the N/N environment, and a third curve 530 indicates the resistance in the H/H environment. The first curve 510 abruptly rises until 40K sheets, declines a little, and abruptly re-rises after 55K sheets. In general, the end point of the first rise is determined as a life termination point of the transfer roller, and the start point of the re-rise is determined as a point where the image quality may be significantly adversely affected. The maximum number of the printable sheets of the transfer roller is approximately 40K in the L/L environment. The second curve 520 considerably rises after 60K sheets, and accordingly, the maximum number of the printable sheets is approximately 60K in the N/N environment. The third curve 530 has the maximum number of the printable sheets of approximately 90K in the H/H environment. That is, the life span becomes longer in the H/H environment and becomes shorter in the L/L environment.

The above characteristics are present not only to the transfer roller but also to other components (for example, a charging roller) of which the operating condition varies depending on the environment. That is, the maximum number of the printable sheets that may be yielded depends on the environment. The environment of the image forming device is apt to vary continuously due to factors such as seasonal variation, daily temperature range, and weather change, while locating at a same location. Consequently, the substantial replacement time cannot be obtained by comparing the total number of the printed sheets with the maximum number of the printable sheets as in the conventional arrangement.

According to an embodiment of the present general inventive concept, the total number of the printed sheets is determined by compensating the actual number of the printed sheets based on a diverse environment. Optimal maximum numbers of the printable sheets, which are determined through experiments in the diverse environment, are compared, and the compensation coefficient for the environment is determined based on a ratio of the compared results. Next, the actual numbers of the printed sheets, which are counted in the diverse environment, are compensated using the related compensation coefficients, and added all together so as to obtain the total number of the printed sheets. Since the total number of the printed sheets is obtained in consideration of effects from the environment, an accurate life span is determined by comparing the total number of the printed sheets with the maximum number of the printable sheets to determine the replacement time. In view of the N/N environment, the print jobs in the L/L environment relatively advance the replacement time of the components, and the print jobs in the H/H environment relatively delay the replacement time.

Figure 6:
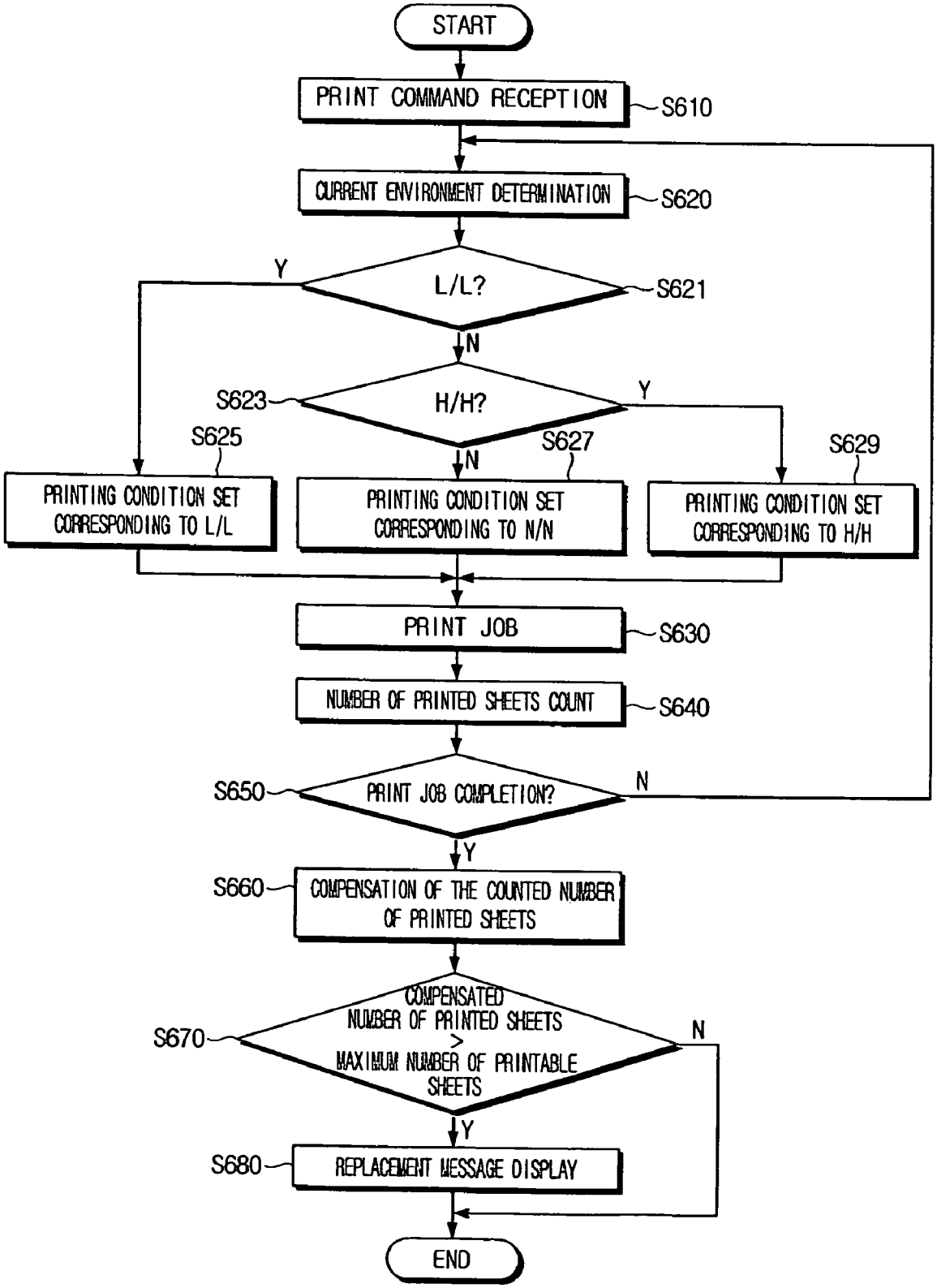
FIG. 6 is a flowchart illustrating a method of checking a life span of a consumable component based on the environment in which it is placed, according to an embodiment of the present general inventive concept.

FIG. 6 illustrates a method of determining the substantial replacement time by compensating the number of the printed sheets depending on the environment of the image forming device when the life span of each component is determined based on the number of the printed sheets. Referring to FIG. 6, the environment of the image forming device is divided into the L/L environment, the H/H environment, and the N/N environment.

When the controller 120 receives the print command through the interface 110 at operation S610, the controller 120 warms up the engine part 160 and simultaneously checks the current environment of the image forming device using the environment detector 130 at operation S620.

After determining whether the current environment is the L/L environment at operation S621 or the H/H environment at operation S623, a suitable printing condition is set corresponding to the determined environment at operations S625 and S629. The printing condition denotes the operating condition to drive each component of the engine part 160. As aforementioned, the environment of the image forming device is checked to properly drive the components, such as the transfer roller and the charging roller, of which the operation condition varies depending on the environment.

If the current environment is neither the L/L nor the H/H environment, the current environment is determined as the N/N environment and the corresponding printing condition is set at operation S627. It will be appreciated that the environment may be divided into five cases including the high temperature and the low humidity (H/L) environment and the low temperature and the high humidity (L/H) environment, or, into two cases of the L/L and the H/H environment. The manufacturer may determine the division of the environment by considering the manufacturing cost and the capacity of the controller 120.

When the printing condition is set, the components of the engine part 160 operate correspondingly to perform the printing job at operation S630. For example, the laser printer performs operations such as charging, writing, developing, transferring, and fusing.

While the above operations are repeated until the printing job is completed, the number of the printed sheets hitherto is accumulated and counted at operations S640 and S650. To perform the printing job, the pickup roller needs to feed the printing sheets. Hence, the number of the revolutions of the pickup roller is counted and is determined as the actual number of the printed sheets.

Next, the controller 120 compensates the actual number of the printed sheets counted based on the environment with the total number of the printed sheets at operation S660. In detail, the actual number of the printed sheets in the environment is compensated using the compensation coefficient corresponding to the environment, and all of the compensated numbers of the printed sheets are added, to thus determine the total number of the printed sheets.

Upon determining the total number of the printed sheets, the controller 120 compares the total number of the printed sheets with a predetermined maximum number of the printable sheets at operation S670. If the total number of the printed sheets exceeds the predetermined maximum number of the printable sheets, the controller 120 determines the replacement and outputs a particular notification message onto the display 170 at operation S680. As a result, the user swiftly perceives and effectively copes with the replacement time of each component.

The compensation of the counted actual number of the printed sheets is illustrated in detail using the transfer roller by way of example. Referring back to FIG. 5, the maximum number of the printable sheets in the L/L environment, the N/N environment, and the H/H environment is approximately 40K, 60K, and 90K, respectively. Provided that one of the L/L environment, the N/N environment, and the H/H environment is a reference section, it is feasible to determine the ratio between the maximum numbers of the printable sheets of the L/L environment, the N/N environment, and the H/H environment.

The image forming device is utilized generally in the N/N environment. Provided that 60K, which is the maximum number of the printable sheets in the N/N environment, is defined as a reference 1, the maximum number of the printable sheets in the L/L environment is approximately 0.66 and the maximum number of the printable sheets in the H/H environment is approximately 1.5. Next, the compensation coefficient is determined in inverse proportion to the ratio. Specifically, when one sheet is actually printed out, it is regarded that one sheet is printed out in the N/N environment, 1.5 (1/0.66) sheets are printed out in the L/L environment, and 0.66 (1/1.5) sheet is printed out in the H/H environment. Accordingly, 1, 1.5, and 0.66 respectively are the compensation coefficient in the N/N, the L/L, and the H/H environments.

The total number of the printed sheets is calculated using an equation of $L=A+1.5B+0.66C$. L denotes the total number of the printed sheets, A denotes the actual number of the printed sheets in the N/N environment, B denotes the actual number of the printed sheets in the L/L environment, and C denotes the actual number of the printed sheets in the H/H environment. Therefore, 1, 1.5, and 0.66 are respectively the compensation coefficient in the N/N, the L/L, and the H/H environments.

Accordingly, the replacement time can be accurately determined by setting the N/N environment as the reference environment, varying the ratio between the numbers of the printed sheets depending on the environment, and comparing the total number of the printed sheets L with the fixed maximum number of the printable sheets. The controller 120 determines the replacement when the calculated total number of the printed sheets L exceeds 60K, which is the maximum number of the printable sheets in the N/N environment.

The reference environment may be any one of the H/H environment and the L/L environment according to the area where the image forming device is utilized. In this case, the replacement time of the component(s) may be determined by setting and compensating the ratio in the reference environment, and comparing the total number of printed sheets with the maximum number of the printable sheets of the reference environment.

In the light of the foregoing, the replacement time of the components is substantially determined based on the environment of the image forming device. Thus, replacement of a still available component is avoided, and the quality of the printed image is prevented from deteriorating due to the improved determination of the replacement time of the component.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming device comprising:

an engine part to perform a printing job using a certain component upon receiving a print command;

an environment detector to detect environmental information of the engine part; and a controller to determine a replacement time of the certain component according to a detection result of the environment detector, wherein the controller determines a total number of printed sheets printed by the engine part by compensating an actual number of the printed sheets reflecting the environmental information, and determines the replacement time of the certain component when the actual number of the printed sheets exceeds a predetermined maximum number of printable sheets of the certain component.

2. The image forming device of claim 1, further comprising a display displaying the replacement time of the certain component when the controller determines the replacement.

3. The image forming device of claim 1,further comprising:

a printout counter to count the actual number of printed sheets of the engine part; and a memory to contain a maximum number of printable sheets of the certain component.

4. The image forming device of claim 3, wherein the certain component is one of a photoconductive drum, a charging roller to charge a surface of the photoconductive drum with a negative charge, a developing roller to attract a toner onto the surface of the photoconductive drum, and a transfer roller to transfer the toner on the surface of the photoconductive drum onto the printed sheet.

5. The image forming device of claim 1, wherein the controller determines the total number of the printed sheets by dividing an environment of the engine part into a plurality of sections depending on the environmental information and compensating the actual number of the printed sheets using a compensation coefficient which is set differentially for each section.

6. The image forming device of claim 5, wherein the compensation coefficient is set by experimentally measuring the maximum number of the printable sheets in each section, calculating a ratio between the maximum numbers of the printable sheets based on the maximum number of the printable sheets in a certain section, and setting the compensation coefficient in inverse proportion to the calculated ratio.

7. The image forming device of claim 6, wherein the environment detector detects the environmental information on at least one of a temperature and a humidity.

8. The image forming device of claim 7, wherein the controller divides the environment of the engine part into a low temperature and low humidity (L/L), a normal temperature and normal humidity (N/N), and a high temperature and high humidity (H/H) depending on the environmental information.

9. The image forming device of claim 8, wherein the controller determines, with the environment of the engine part being the N/N, that the replacement time relatively advances in the L/L and that the replacement time is relatively delayed in the H/H.

10. The image forming device of claim 8, wherein the controller determines the total number of the printed sheets based on the following equation:

$$L=\alpha A+\beta B+\delta C,$$

where L denotes the total number of the printed sheets, A, B, and C respectively denotes the number of the printed sheets in the N/N, the L/L, and the H/H, and α, β, and δ respectively represent the compensation coefficient in the N/N, the L/L, and the H/H.

11. The image forming device of claim 1, wherein the environment information is detected by applying a measuring voltage to the component, detecting a current of the component, and measuring a resistance of the component.

12. A method of determining a replacement time of a certain component of an image forming device which performs a print job using the certain component, the method comprising:

performing the print job by driving the certain component upon receiving a print command;

detecting an environmental information on an environment of the image forming device; and determining the replacement time of the certain component depending on the detected environmental information by counting a number of printed sheets of the image forming device, determining a total number of the printed sheets by differentially compensating the number of the printed sheets depending on the environmental information, and determining the replacement time of the certain component when the total number of the printed sheets exceeds a maximum number of printable sheets of the certain component.

13. The method of claim 12, further comprising displaying a replacement message of the certain component when the replacement time of the certain component is determined.

14. The method of claim 12, wherein the operation of determining the replacement time of the certain component depending on the detected environmental information comprises:

dividing the environment of the image forming device into a plurality of sections depending on the environmental information; and determining the total number of the printed sheets by compensating an actual number of the printed sheets using a compensation coefficient differentially set for each section.

15. The method of claim 14, wherein the compensation coefficient is set by experimentally measuring the maximum number of the printable sheets in each section, calculating a ratio between the maximum numbers of the printable sheets based on the maximum number of the printable sheets in a certain section, and setting the compensation coefficient in inverse proportion to the calculated ratio.

16. The method of claim 12, wherein the environmental information is related to at least one of a temperature and a humidity.

17. The method of claim 16, wherein the operation of determining the replacement time of the certain component depending on the detected environmental information comprises dividing the environment of the image forming device into a low temperature and low humidity (L/L), a normal temperature and normal humidity (N/N), and a high temperature and high humidity (H/H).

18. The method of claim 17, wherein the operation of determining the replacement time of the certain component depending on the detected environmental information comprises determining the total number of the printed sheets based on the following equation:

$$L=\alpha A+\beta B+\delta C,$$

where L denotes the total number of the printed sheets, A, B, and C respectively denote the number of the printed sheets in the N/N, the L/L, and the H/H, and α, β, and δ respectively denote the compensation coefficient in the N/N, the L/L, and the H/H.

19. The method of claim 17, wherein the operation of determining the replacement time of the certain component when the total number of the printed sheets exceeds a maximum number of printable sheets of the certain component determines, with the environment of the image forming device being the N/N, that the replacement time relatively advances in the L/L and that the replacement time is relatively delayed in the H/H.

20. An image forming apparatus including at least one expendable component used during printing of images on printing mediums, comprising:

an environment detector to detect environmental information of the expendable component; and a controller to determine a replacement time of the expendable component based on a detection result of the environment detector, wherein the controller determines a total number of printed mediums printed by compensating the actual number of the printed mediums based on the environmental information, and determines the replacement time of the expendable component when an actual number of the printed mediums exceeds a predetermined maximum number of printable mediums of the expendable component.

21. The image forming apparatus of claim 20, further comprising:

a printout counter to count the actual number of printed mediums; and a memory to contain a maximum number of printable mediums of the expendable component.

22. The image forming apparatus of claim 21, wherein the expendable component is one of a photoconductive drum, a charging roller to charge a surface of the photoconductive drum with a negative charge, a developing roller to attract a toner onto the surface of the photoconductive drum, and a transfer roller to transfer the toner on the surface of the photoconductive drum onto the printed medium.

23. The image forming apparatus of claim 20, wherein the controller determines the total number of the printed mediums by dividing an environment of the image forming apparatus into a plurality of sections depending on the environmental information and compensating the actual number of the printed mediums using a compensation coefficient which is set differentially for each section.

24. The image forming apparatus of claim 23, wherein the compensation coefficient is set by experimentally measuring the maximum number of the printable mediums in each section, calculating a ratio between the maximum numbers of the printable mediums based on the maximum number of the printable mediums in a certain section, and setting the compensation coefficient in inverse proportion to the calculated ratio.

25. The image forming apparatus of claim 24, wherein the environment detector detects the environmental information on at least one of a temperature and humidity.

26. The image forming apparatus of claim 25, wherein the controller divides the environment into a low temperature and low humidity (L/L) environment, a normal temperature and normal humidity (N/N) environment, and a high temperature and high humidity (H/H) environment depending on the environmental information.

27. The image forming apparatus of claim 26, wherein the controller determines the total number of the printed mediums based on the following equation:

$$L=\alpha A+\beta B+\delta C,$$

where L denotes the total number of the printed mediums, A, B, and C respectively denote the number of the printed mediums in the N/N, the L/L, and the H/H environments, and $\alpha$, $\beta$, and $\delta$ respectively represent the compensation coefficient in the N/N, the L/L, and the H/H environments.

28. An image forming apparatus, comprising:

at least one replaceable mechanical component;

an environment detecting unit to detect an environment of the mechanical component;

a memory unit to store a predetermined compensation coefficient corresponding to the environment; and a controller to count an actual number of print jobs printed by the image forming apparatus, to modify the calculated actual number of print jobs using the predetermined environment compensation coefficient stored in the memory unit, and to determine whether the modified number of print jobs is greater than a predetermined threshold number for the mechanical component.

29. A method of monitoring a lifespan of a mechanical component of an image forming apparatus, the method comprising:

calculating an actual number of print jobs printed by the image forming apparatus;

modifying the calculated actual number of print jobs using a predetermined environment compensation coefficient; and determining whether the modified number of print jobs is greater than a predetermined threshold number for the mechanical component.

* * * * *